US008311684B2

(12) United States Patent
Riverin

(10) Patent No.: US 8,311,684 B2
(45) Date of Patent: Nov. 13, 2012

(54) OUTPUT FLOW CONTROL IN LOAD COMPRESSOR

(75) Inventor: Guy Riverin, Montreal (CA)

(73) Assignee: Pratt & Whitney Canada Corp., Longueuil (CA)

( * ) Notice: Subject to any disclaimer, the term of this patent is extended or adjusted under 35 U.S.C. 154(b) by 751 days.

(21) Appl. No.: 12/336,882

(22) Filed: Dec. 17, 2008

(65) Prior Publication Data

US 2010/0152918 A1 Jun. 17, 2010

(51) Int. Cl.
*G05D 16/00* (2006.01)

(52) U.S. Cl. ..... 700/301; 701/100; 60/772

(58) Field of Classification Search ..... 700/301, 700/44, 282, 287; 60/772, 779, 784, 792; 701/100; 415/17, 27; 62/228.3
See application file for complete search history.

(56) References Cited

U.S. PATENT DOCUMENTS

| | | | | |
|---|---|---|---|---|
| 3,867,717 | A | 2/1975 | Moehring et al. | |
| 4,164,033 | A | 8/1979 | Glennon et al. | |
| 4,164,035 | A | 8/1979 | Glennon et al. | |
| 4,894,782 | A * | 1/1990 | Alcock et al. | 701/100 |
| 4,949,276 | A | 8/1990 | Staroselsky et al. | |
| 5,022,224 | A * | 6/1991 | Smith | 60/792 |
| RE34,388 | E * | 9/1993 | Dubin et al. | 60/779 |
| 5,306,116 | A | 4/1994 | Gunn et al. | |
| 5,683,223 | A | 11/1997 | Harada et al. | |
| 5,908,462 | A | 6/1999 | Batson | |
| 5,913,248 | A | 6/1999 | Harada et al. | |
| 6,141,951 | A | 11/2000 | Krukoski et al. | |
| 6,213,724 | B1 | 4/2001 | Haugen et al. | |
| 6,364,602 | B1 | 4/2002 | Andrew et al. | |
| 6,532,433 | B2 * | 3/2003 | Bharadwaj et al. | 702/182 |
| 7,007,472 | B2 * | 3/2006 | Baize et al. | 60/602 |
| 7,069,137 | B2 * | 6/2006 | Miller | 701/100 |
| 7,094,019 | B1 | 8/2006 | Shapiro | |
| 7,100,375 | B2 * | 9/2006 | Baize et al. | 60/602 |
| 7,650,777 | B1 * | 1/2010 | Krok et al. | 73/112.06 |
| 7,762,084 | B2 * | 7/2010 | Martis et al. | 60/792 |
| 7,827,803 | B1 * | 11/2010 | Wadia et al. | 60/772 |
| 7,866,159 | B2 * | 1/2011 | Bowman et al. | 60/772 |
| 2008/0264067 | A1 * | 10/2008 | Flucker et al. | 60/793 |

* cited by examiner

*Primary Examiner* — Dave Robertson
(74) *Attorney, Agent, or Firm* — Norton Rose Canada LLP

(57) ABSTRACT

A system and a method useful for determining and controlling flow in an engine load compressor 102 having an inlet 104 and an outlet 106. Means 108 are provided for measuring static pressure at one or more locations within the load compressor inlet 104. Means 108 are also provided for measuring static pressure at one or more locations within the load compressor outlet 106. The system further comprises means 112 for measuring temperature at at least one location within the compressor, and one or more processors 114 adapted for calculating ratios relating compressor outlet and inlet pressures, optionally normalizing the calculated pressure ratios according to any one or more of reference temperatures, inlet guide vane positions, and compressor speeds, and for determining, using the optionally normalized pressure ratios, desired load compressor output flow rates Q.

22 Claims, 5 Drawing Sheets

TABLE 1 PR @ 0 DEG C

| IGV | A -54 | A 0 | A 70 |
|---|---|---|---|
| 10 | 0.9600 | 1.0000 | 1.0600 |
| 20 | 0.9406 | 1.0000 | 1.0803 |
| 30 | 0.9200 | 1.0000 | 1.1098 |
| 40 | 0.9038 | 1.0000 | 1.1337 |
| 50 | 0.8844 | 1.0000 | 1.1631 |
| 60 | 0.8717 | 1.0000 | 1.1829 |
| 70 | 0.8535 | 1.0000 | 1.2118 |
| 80 | 0.8329 | 1.0000 | 1.2454 |
| 86 | 0.8237 | 1.0000 | 1.2609 |

402

TABLE 2 PR @ 50% IGV

| IGV | CF |
|---|---|
| 10 | 1.67 |
| 22 | 1.379188 |
| 30 | 1.223501 |
| 40 | 1.094069 |
| 50 | 0.999974 |
| 60 | 0.930045 |
| 70 | 0.872221 |
| 80 | 0.822134 |
| 86 | 0.799404 |

404

TABLE 3 PR TO Q

| PR_OC_50 | Q13PR |
|---|---|
| 5.322 | 4 |
| 4.59 | 5 |
| 3.947 | 6 |
| 3.829 | 6.2 |
| 3.66 | 6.5 |
| 3.39 | 7 |
| 2.928 | 8 |
| 2.55 | 9 |
| 2.263 | 10 |
| 2.064 | 11 |

406

FIG. 5

OUTPUT FLOW CONTROL IN LOAD COMPRESSOR

TECHNICAL FIELD

The application relates generally to load compressors, and more particularly to improved systems and methods for monitoring and controlling output flow in load compressors.

BACKGROUND OF THE ART

Systems and methods for controlling compressor surge are described in U.S. Pat. Nos. 4,164,033 and 4,164035, both issued 7 Aug. 1979 to Timothy F. Glennon et al.

However, the systems and methods disclosed in those patents, and elsewhere in the prior art, are more complex, more difficult to trim or adjust, and less accurate, responsive and efficient than necessary. In view of the need for rapid and accurate responses for compressor control systems, there is a need for improvement.

SUMMARY

The application provides load compressors; systems and methods for controlling load compressors, and particularly outlet flow from load compressors; and turbine engines comprising such compressors and systems.

For example, in one aspect there is provided systems useful for controlling flow in a load compressor having an inlet and an outlet. Such systems comprise means for measuring static pressure at one or more locations within the load compressor inlet, means for measuring static pressure at one or more locations within the load compressor outlet (for example, either absolute pressure or the change in pressure, or delta, between the compressor outlet and inlet), means for measuring temperature at at least one location within the compressor, and one or more processors adapted for calculating ratios relating compressor outlet and inlet pressures, normalizing the calculated pressure ratios according to any one or more of reference temperatures, inlet guide vane positions, and compressor speeds, and determining, using the optionally normalized pressure ratios, desired load compressor output flow rates.

In accordance with another general aspect, there is provided a method for controlling flow in a load compressor having an inlet and an outlet, the method performed by an automatic data processor and comprising: measuring static pressure at the load compressor inlet; measuring static pressure at the load compressor outlet; measuring temperature at at least one location within the compressor; calculating a ratio relating the measured compressor outlet pressure to the measured compressor inlet pressure, normalizing the calculated pressure ratio according to a reference temperature, and determining, using the normalized pressure ratio, a desired load compressor output flow rate, allowing for accurate control of the desired load compressor output flow rate to prevent, for example, surge in the load compressor.

In accordance with a further aspect, there is provided a load compressor comprising: an inlet, and means for measuring static pressure (for example, absolute pressure measured in psia) at the inlet; an outlet, and means for measuring static pressure (for example, absolute pressure measured in psia) at the outlet; means for measuring temperature at at least one location at the inlet, within, or after the compressor; a processor adapted for calculating a ratio relating the measured outlet pressure to the measured inlet pressure, normalizing the calculated pressure ratio according to a reference temperature, and for determining, using the normalized pressure ratio, a desired load compressor output flow rate, the desired load compressor output flow rate useable, for example, for preventing surge in the load compressor.

Further details of these and other aspects of the subject matter of this application will be apparent from the detailed description and drawings included below.

DESCRIPTION OF THE DRAWINGS

Reference is now made to the accompanying drawings, in which:

FIG. 5 provides example tables comprising factors useful for determining load compressor output flow rates.

DETAILED DESCRIPTION OF PREFERRED EMBODIMENTS

Various aspects of preferred embodiments of load compressors, flow control systems, methods, and turbine engines according to the application are described through reference to the drawings.

Figure 1:
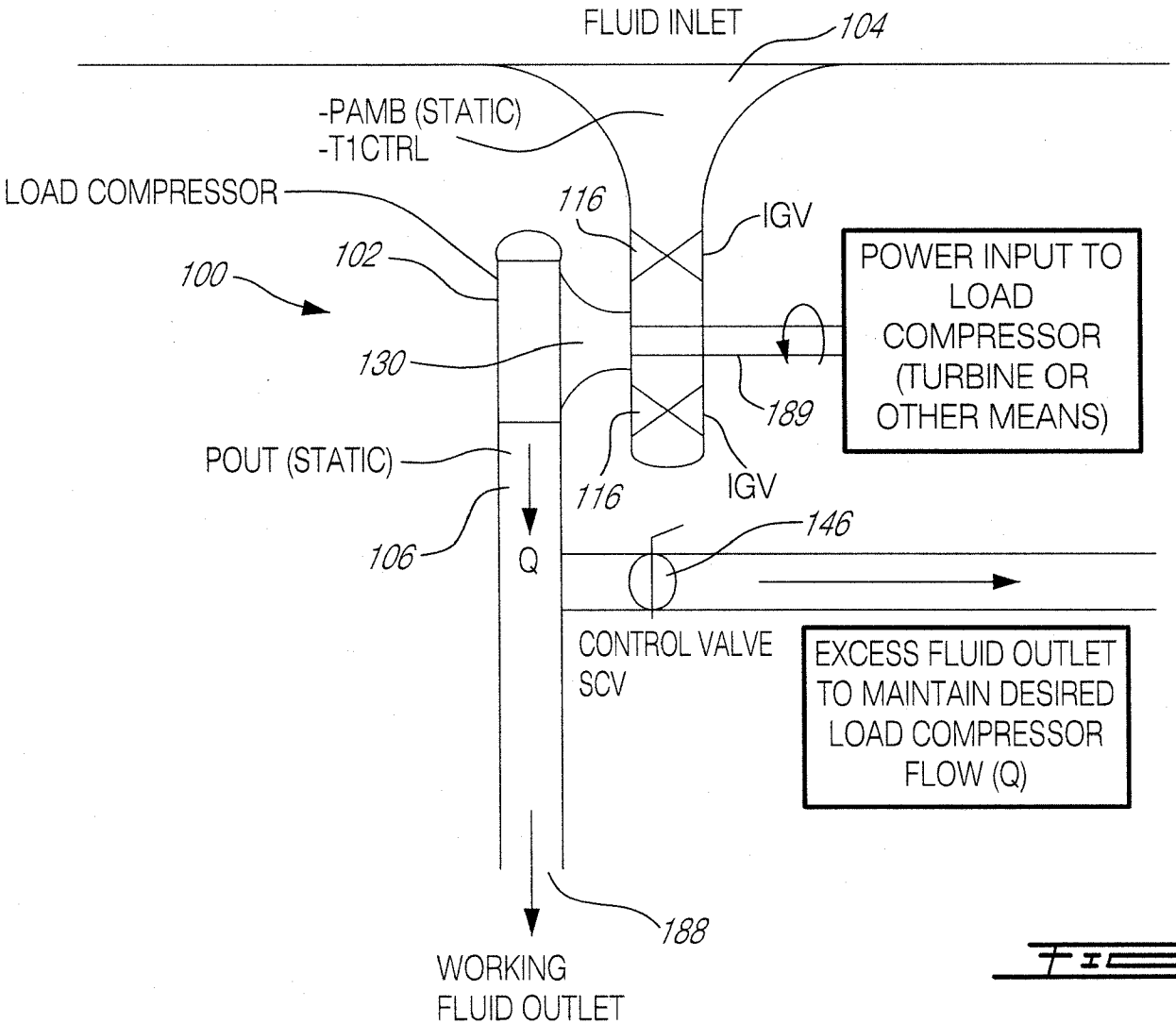
FIG. 1 is a schematic diagram of an embodiment of a load compressor incorporating systems and operable according to methods for control of flow in load compressors in accordance with embodiments of the invention.

FIG. 1 is a schematic diagram of an embodiment of a load compressor incorporating a system 100 for controlling the output flow of a load compressor in accordance with the invention. In the embodiment shown, system 100 comprises a load compressor 102, which comprises inlet 104; one or more load compression stages 130, each of which may comprise one or more inlet guide vane stages (IGV) 116; and an outlet section 106. As will be understood by those skilled in the relevant arts, load compressor 102 may be driven by a gas or water turbine, an electric motor, or any other suitable source of adequate rotary power. Measured flow function Q, which is defined as compressor exit mass flow*SQRT(exit temp)/exit pressure)

is the mass flow rate of air (or other gas or fluid) exiting the compressor. As will be understood by those skilled in the relevant arts, flow Q can be modulated or otherwise controlled by various means, including for example inlet guide vane 116 position, compressor speed (often denoted N1), and/or surge control valve 146 (SCV) position. In the example shown in FIG. 1, the load compressor 102 can be the load compressor of an auxiliary power unit (APU) provided, for example, on an aircraft, and the compressed air provided at working fluid outlet 188 can be delivered to an environmental control system (ECS) or main engine start (MES) system.

In the APU example shown, load compressor 102 is mounted on and driven by a separate shaft 189 and may be driven at a constant speed, for example 100% design mechanical, by a variable speed gas generator compressor and turbine, electric motor, etc., and load compressor 102 does not supply any bleed air for purposes such as driving or controlling the gas generator. One advantage offered by measuring Q, and then governing operation of the load compressor 102 by controlling any one or more of inlet guide vane 116 position, compressor speed (often denoted N1), and/or surge control valve 146 (SCV) so as to provide a substantially constant Q, is that the compressor can run on fixed working lines regardless of IGV position, temperature or inlet pressure. See, for example, FIG. 2, which provides a sample experimentally-derived plot of pressure ratio across the compressor 130 as a function of corrected flow rates (in pounds per second) along lines of constant Q for a load compressor engine configured in accordance with the invention. As may be seen in that Figure, mass flow remains relatively constant, as a function of pressure ratio and Q, to the point of compressor surge (which occurs along the line of Q approximately equal to 5.5) Thus the invention, by providing rapid and accurate measurements of Q, enables the load compressor to operate along the surge line without surging the compressor, and thereby deliver smoother and more constant bleed air, and smoother SCV movements.

Figure 3:
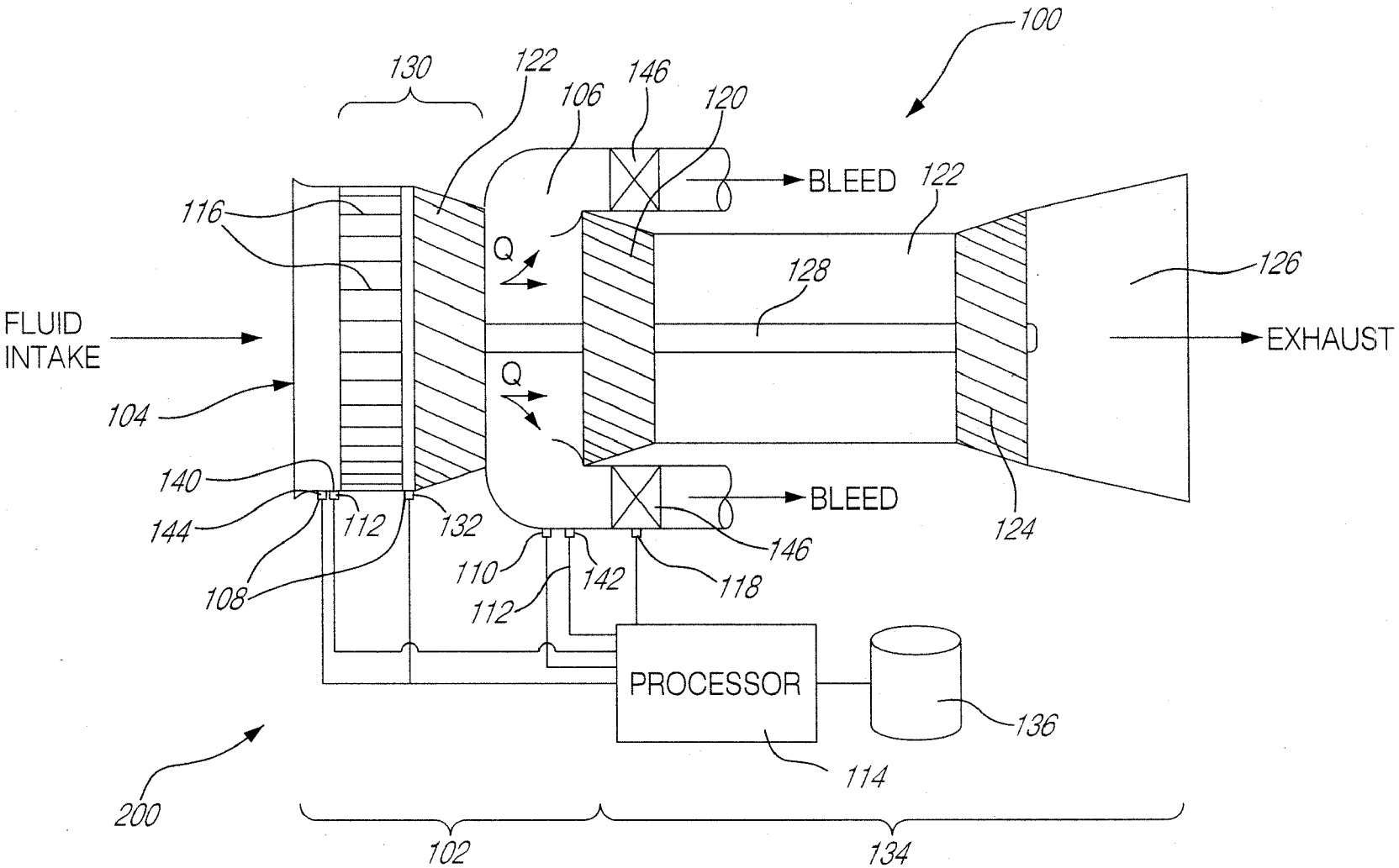
FIG. 3 is a schematic diagram of an embodiment of a turbine engine incorporating systems and operable according to methods for control of flow in load compressors in accordance with embodiments of the invention.

FIG. 3 is a schematic diagram of an embodiment of a turbine engine incorporating a system 100 for controlling the output flow of a load compressor in accordance with the invention. In the embodiment shown, system 100 comprises a load compressor 102 and a turbine core 134. Load compressor 102 comprises inlet 104; one or more load compression stages 130, each of which may comprise one or more inlet guide vane stages 116 and/or rotor stages 132; and an outlet section 106. As noted above, a turbine engine is one of many applications which can use the methods and systems described herein for measuring and controlling Q. In the embodiment shown, turbine core 134 comprises one or more core compressor stages 120, fuel injection and combustion section 122, one or more turbine stages 124, and an exhaust section 126.

As will be well understood by those skilled in the relevant arts, compressors stages 132, 120 and turbine stage(s) 124 may be mounted on one or more common shafts 128, such that, as shafts 128 spin, they drive compressor rotors 132, 120, and draw air (or other suitable gas or other fluid) into inlet 104, so that the fluid is compressed by compressor stage(s) 130 of load compressor 102. Upon exiting load compressor stage(s) 130, a portion Q of the compressed fluid is bled through load compressor outlet section 106 for uses such as cabin environmental control in an aircraft or other vehicle; and a portion is passed to core compressor 120 for injection of fuel and combustion in section 122, such that the heated, expanding flow causes turbine stage(s) 124 to spin, and thereby continue driving compressor shaft(s) 128 and thus rotors 132, 120, as well as optional additional machinery such as generators and/or gearboxes (not shown).

In the embodiment shown, turbine engine 100 of FIG. 3 further comprises system 200 for controlling fluid flow in the load compressor 102. In the embodiment shown, system 200 comprises means 108 for measuring static pressure at one or more points within the load compressor inlet 104, means 110 for measuring static pressure at one or more points within the load compressor, preferably before the inlet guide vanes 116 or in outlet 106; means 112 for measuring temperature at at least one location within the load compressor 102; and one or more processors 114 adapted for calculating a desired load compressor output bleed rate, or other output flow rate Q from outlet section 106. Among other functions, the calculations made by processor(s) 114 may be used for maintaining desired levels of output flow Q while avoiding compressor surge in the load compressor 102.

Means 108 for measuring static pressure at one or more points in the load compressor inlet 104 and means 110 for measuring static pressure at one or more points in the load compressor outlet 106 can comprise any sensors or other devices suitable for use in measuring the pressure of gas or other fluid(s) present at corresponding locations in the load compressor 102. A wide variety of sensors suitable for use in measuring such pressure(s) are now known, and doubtless will hereafter be developed. Those skilled in the relevant arts will not be troubled in the selection of suitable devices. In some presently-preferred embodiments, preferred load compressor inlet pressure transducers 108 have ranges of 1.5 to 16.6 pounds per square inch absolute (psia), while the load compressor outlet static pressure sensor has a range of 0 to 100 PSIA and an accuracy of +/−1.4%.

It is preferred, in implementing various of the embodiments disclosed herein, to use static, as opposed to dynamic, fluid pressures, since in many cases static pressure provides more reliable and accurate data for relevant purposes. Moreover, as will be appreciated by those skilled in the relevant arts, in many currently common engine configurations static pressure is easier to acquire (i.e., to install sensors to obtain), and is less affected (i.e. produces a cleaner, more accurate signal) by turbulence or other flow characteristics, such as varying airflow, dynamic pressure and its corresponding transducers. Moreover, in many embodiments it is preferred to use absolute, rather than gage, pressure. However, as will be apparent to those skilled in the relevant arts, dynamic and/or gage pressure sensors can be used as well.

Means 112 for measuring temperature at at least one location within load compressor 102 can comprise any sensors or other devices suitable for use in measuring the temperature of gas or other fluid(s) at appropriate points the load compressor. A wide variety of sensors suitable for such use are now known, and doubtless will hereafter be developed. Those skilled in the relevant arts will not be troubled in the selection of suitable devices. In some presently-preferred embodiments, preferred temperature sensors 112 are of the Resistive Thermal Device or RTD type, and provide accuracies of +/−2.55 deg C. over measurement ranges of −80 deg C. to 90 deg C.

Means 108, 110, and 112 for measuring static pressures and temperatures may be located at any suitable points within the inlet and outlet portions of load compressor 102. As will be understood by those skilled in the relevant arts, single sensors may be placed in each location within the inlet section 104 and outlet section 106, or several sensors may be placed in separate locations in each section, and the data provided thereby processed jointly or separately, as desired. Methods of placing temperature and pressure sensors in fluid- or gas dynamic machinery are well understood.

Processor(s) 114 can comprise any automatic data processing devices, systems, and/or programming, or combinations thereof, adapted for calculating desired load compressor output rates for bleed air or other output flows Q from outlet section 106 as described herein. Thus processor(s) 114 can comprise any combinations of hardware and/or software suitable for such purposes, including for example suitably-programmed special-purpose or general-purpose solid-state circuits such as integrated circuit boards, working, as necessary or desired, with suitably-configured software operating systems and/or other control programming. Processor(s) 114 can further be associated with other desired hardware components, such as volatile or persistent memories 136 and/or other data storage/access and communications means, including, as desired input and/or output means.

In general, processor(s) 114 can calculate a desired load compressor output flow rate Q by determining a pressure ratio relating the measured compressor outlet pressure to the measured compressor inlet pressure, normalizing the calculated pressure ratio according to a reference temperature, and determining, using the normalized pressure ratio, the desired load compressor output flow rate Q.

For example, static inlet pressure may be read at one or more points in load compressor inlet 104, either upstream or downstream of any stator vanes 116; and at one or more points in outlet section 106, using known pressure transducers, and electronic signals representing such pressures may be generated and provided as input to processor(s) 114, using known data acquisition and communications means. Likewise, signals representing flow temperature(s) at one or more points in inlet 104 and/or outlet section 106 can be created using known temperature transducers, and provided as input to processor(s) 114, using known data acquisition and communications means. Processor(s) 114 can use the acquired pressure signals to calculate pressure ratios Pr of outlet and inlet pressures using known data processing techniques, and can normalize the pressure ratios to desired reference temperatures (e.g., 0 degrees C.) using for example known fluid dynamics analysis techniques. Processor(s) 114 can then use the normalized pressure ratios to determine desired load compressor outlet flows Q suitable for satisfying any desired bleed air requirements while preventing surge or stall in load compressor 102 and or core compressor 120.

Figure 2:
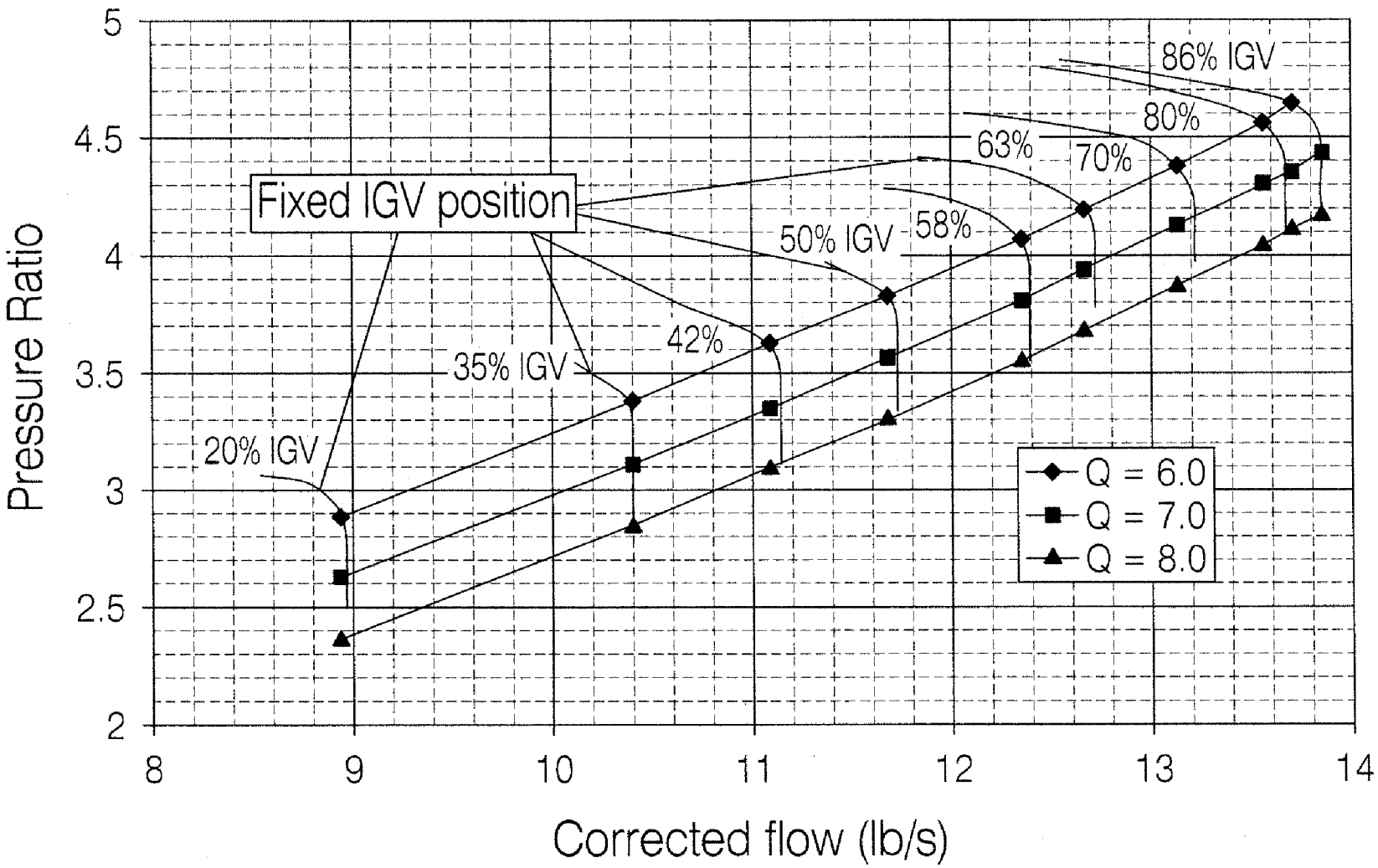
FIG. 2 provides a sample experimentally-derived plot of pressure ratio across the compressor 130 as a function of corrected flow rates (in pounds per second) along lines of constant Q for a load compressor engine configured in accordance with the invention.

For example, normalized pressure ratios associated with output flow rates Q suitable for satisfying known bleed air requirements without causing compressor surge can be determined empirically, by means of engine tests, as shown for example in the data of FIG. 2, and tabulated according to known or suitably-adapted data acquisition, reduction, and processing techniques; and processor(s) 114 can be programmed or otherwise configured to determine desire flow rates Q by using suitably-stored data and suitably-adapted table look-up procedures. If needed or desired, various other factors can be controlled to fine tune engine variations, e.g., trim values for moveable inlet guide vanes.

The use of table look-up procedures in accordance with the invention has been noted to provide significant improvements in the efficiency and speed of making desired flow rate calculations, and thus to provide improved engine response, reliability, efficiency, and safety.

Calculated desired flow rates Q can be used by processor(s) 114, along with data representing other relevant operating conditions, to determine desired surge or other control valve settings; and signals useful for commanding automated valve control devices to open or close such valves, and thereby control output flow Q, can be generated and output to such devices by processor(s) 114.

As will be understood by those skilled in the relevant arts, where pressure ratios Pr calculated by the processor(s) 114 are to be normalized to a desired reference temperature, the reference temperature(s) to be used may be selected based on a large number of considerations, including for example the location or locations within the load compressor 102 at which temperatures are to be read, the geometry of the load compressor, and known or anticipated operating conditions. For example, temperatures may be read within inlet 104 at location 140, as shown in FIG. 1, and/or in outlet section 106, as shown at 142. Where the pressure ratio is to be normalized to reference temperature(s), a single reference temperature may be used in all conditions, or different reference temperatures may be used in different conditions (e.g., altitude, known or expected flight profile, etc.). It has been found to be advantageous, in some embodiments of the invention intended to be used in, for example, auxiliary power units (APUs) for jet aircraft, to use a reference temperature of zero (0) degrees centigrade.

In some embodiments, and particularly where variable geometry inlet guide vanes 116 are used in the load compressor 102, it has been found desirable to measure static pressure at the load compressor inlet downstream of the inlet guide vanes, as shown at 138 in FIG. 3. In such embodiments, it may not be necessary, for example, to normalize the pressure ratio calculated by the processor(s) 114 for guide vane position.

Particularly where placement of suitable sensors or other means 108 for reading inlet pressure downstream of the inlet guide vanes 116 is impracticable or undesirable, it can be appropriate to measure inlet pressure upstream of inlet guide vanes 116, as shown at 144 in FIG. 3. In such embodiments, and particularly where variable geometry inlet guide vanes 116 are used in the load compressor 102, pressure ratios Pr calculated by processor(s) 114 can be normalized to one or more reference guide vane settings. For example, it has been found to be advantageous, in some embodiments, to normalize such pressure ratios to guide vane settings of 50% (where 100% is fully opened and 0% is fully closed).

In further embodiments, particularly where variable speed compressors are to be used in load compressor 102, pressure ratios Pr calculated by processor(s) 114 can be normalized to one or more reference compressor speeds. For example, operating speeds of variable speed compressors are commonly expressed in percentages of design operating speeds. Thus pressure ratios may be normalized, using for example known fluid dynamics analysis techniques, to 100% design operating speed.

As will be understood by those skilled in the relevant arts, processor(s) 114, in calculating and normalizing pressure ratios Pr, can use any one or more of expressly programmed fluid-dynamic formulae, suitably-adapted finite difference or finite element models and routines, and/or suitably-adapted table look-up routines. It has been found advantageous, for example, in order to maximize the speed and efficiency of such calculations, to provide one or more data sets representing such tables in memory(ies) 136 associated with processor(s) 114, and to use known database or other data processing techniques to access and, as necessary, interpolate such data in calculating and normalizing pressure ratios Pr according to desired factors.

In addition to the selection of output flow rates Q suitable for bleed air requirements, processor(s) 114 can, as will be understood by those skilled in the relevant arts, process pressure ratios Pr to monitor flow conditions and control output flow rates Q to prevent surges in either or both of load compressor 102 or core compressor 120.

Figure 4:
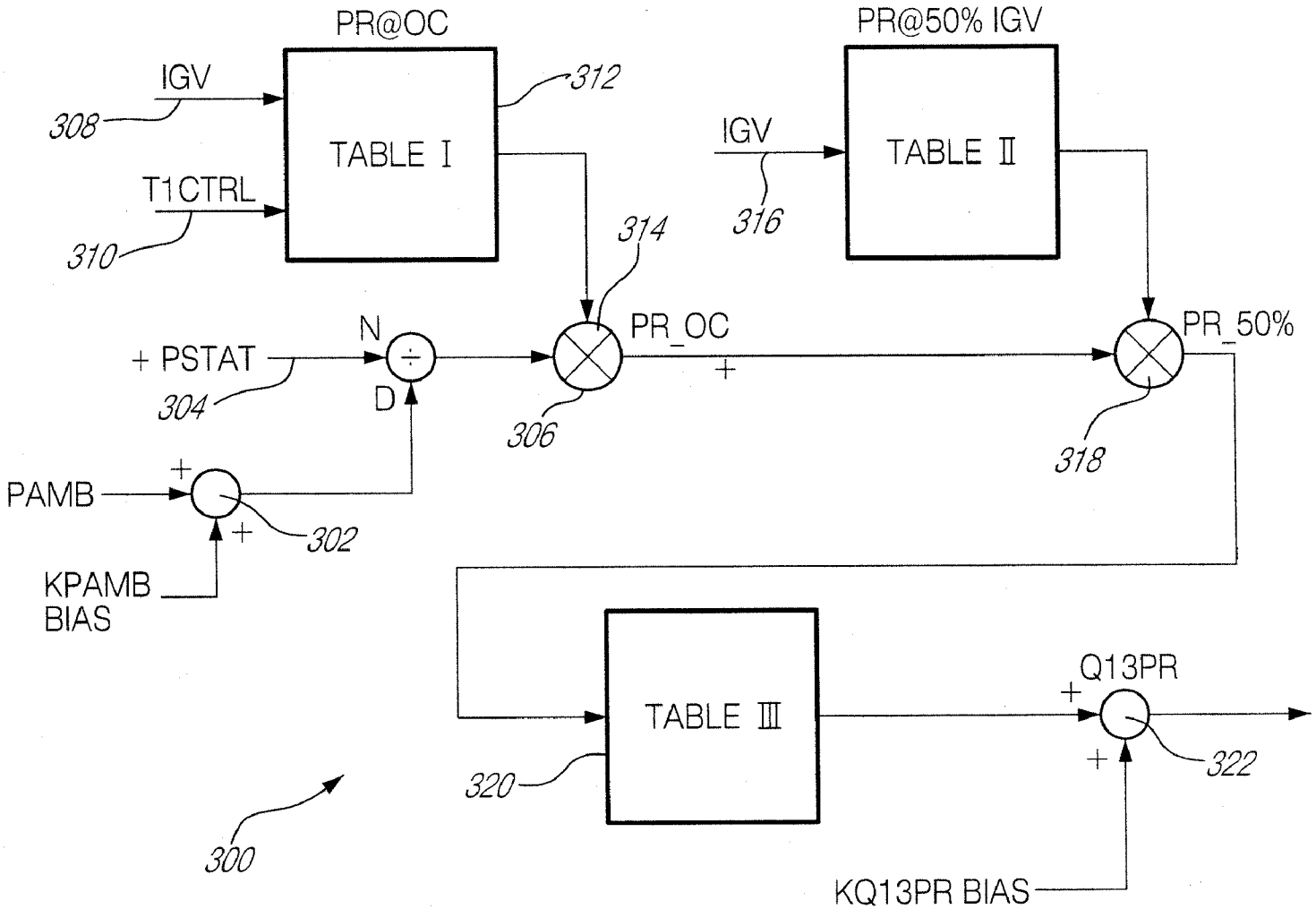
FIG. 4 is a schematic diagram of an embodiment of a process flow for measuring flow function Q and controlling outlet flow in load compressors, suitable for implementation by systems in accordance with an embodiment of the invention.

FIG. 4 is a schematic diagram of an embodiment of a process or logic flow for measuring and controlling outlet flow in load compressors. In particular, process 300 is suitable for implementation by processor(s) 114 as described herein, operating in conjunction with load compressors 102 as shown, for example, in FIG. 1.

In the embodiment shown in FIG. 4, process 300 can be viewed as beginning at 302 with acquisition by suitably-disposed and configured sensors of static inlet pressure(s). Such pressures can be acquired, measured, for example, in absolute terms, in pounds per square inch (psia), as for example by means 108 at one or more locations 144 in inlet 104, as shown in FIG. 1, and provision of corresponding signals to processor 114. At 304 static pressure at one or more locations in outlet section 106 is acquired, and corresponding signals are provided to processor(s) 114. At 306, a pressure ratio Pr is calculated by processor(s) 114 by, for example dividing outlet pressure 304 by inlet pressure 302. Where desired, noise and other transient transducer errors can be eliminated, by for example through the use of guide vane trim values and/or pressure transducer trim KPAMB BIAS added at point 302.

At 310, inlet temperature is acquired by one or more suitably-disposed temperature sensors, and corresponding signals are provided to processor(s) 114. Optionally, at 308 current inlet guide vane (IGV) position is also acquired. In applications in which compressor speed is to be varied, as for example where inlet guide vane position is fixed, load compressor speed can be varied at this point. Acquired temperatures, guide vane positions, and or compressor speeds may be used in normalizing the pressure ratio Pr determined at 306 for further use in determining desired outlet flow rate Q.

An example of a table 402 suitable for use in implementing a stored data structure providing normalization factors to normalize pressure ratios Pr for three (3) input temperature ranges and various guide vane positions in a variable-guide vane compressor is shown in FIG. 5. Values of Pr normalization factors are provided for inlet guide vane positions of 10, 20, 30, 40, 50, 60, 70, 80, and 86% open (where 100% is fully opened and 0% is fully closed), and ambient temperatures of −54, 0, and 70 degrees centigrade are provided.

For example, if an ambient inlet temperature is determined by means 112 to be −54 degrees centigrade, and current IGV position is determined to be 60% (where 100% is fully opened and 0% is fully closed), a normalization factor of 0.8717 can be read by processor(s) 114 from a table 402 stored in a memory 136, and applied at 314 to a pressure ratio Pr calculated at 306, in order to normalize the pressure ratio to zero (0) degrees Celsius.

At 318, a further normalization based on a desired inlet guide vane (IGV) position, (for example 50% open) can be applied to the pressure ratio Pr determined at 314. A current inlet guide vane (IGV) position may be acquired, as for example through use of suitably-configured positioning sensors, and by accessing a table 404 processor(s) 114 can determine a further normalization factor. The output of process 318 is the pressure ratio Pr normalized for temperature (e.g., to 0 degrees Celsius) and IGV position (e.g, 50% open). That is, the output is the Pr that would theoretically be obtained by the load compressor if inlet temperature was 0 deg Celsius and the IGVs were at a setting of 50%.

For example, table 404 suitable for use in implementing a stored data structure providing normalization factors for variable guide vane positions in a variable-guide vane compressor is shown in FIG. 5. Values of Pr normalization factors are provided for inlet guide vane positions of 10, 22, 30, 40, 50, 60, 70, 80, and 86% open.

In FIG. 5, table 406 provides coefficients useful for determining, based upon a Pr previously normalized for temperature and IGV position, a desired coefficient Q. For example, if the normalized Pr is 3.829, then the measured flow coefficient Q is 6.2 In the example shown, the flow coefficient Q is expressed in terms of the parameter Q13, which is defined as the flow measured at station 1.3, immediately after the load compressor exit, as shown for example at 106 in FIGS. 1 and 3.

For example, if a current IGV position is determined to be 50%, a normalization factor of 0.999974 can be read by processor(s) 114 from a table 404 stored in a memory 136, and applied at 318 to a pressure ratio Pr calculated at 306 and normalized for temperature at 314, if applicable. This results in a Pr normalized to 0 deg C., 50% IGV. Note that in FIG. 4 output PR_0 C is Pr normalized to 0 deg and PR_50% is Pr normalized to 50%, the final result being a Pr normalized to 0 deg C. and 50% IGV. This pressure ratio is then applied to table 3 (table 406 of FIG. 5) which converts the normalized Pr to a target Q. In addition, a trim value KQ13PR_BIAS is applied at 322 to account for trim during pass-off testing to cater to production engine variations, (eg compressor efficiency, IGV measurement error, sensor errors etc.) trim biases can be included wherever deemed necessary, based on development engine test results.

With a calculated pressure ratio Pr normalized as desired, at 320 processor(s) 114 can access in memory(ies) 136 data representing formulae or further tables relating the calculated (and optionally normalized) pressure ratios to desired outlet flow rate Q. For example, if processor(s) 114 calculate a (normalized) pressure ratio of 3.66, processor(s) 114 can access a table 406 and, using known table look-up functions, determine a measured non-dimensional flow factor Q of 6.5

Processor(s) 114 can further, using the determined measured Q value, provide a suitable command signal to a suitably-configured controller to cause a control valve 146 to move to a relatively more opened or more closed position, thereby adjusting outlet flow Q to the desired target value.

As will be understood by those skilled in the relevant arts, table look-up functions employed with tables such as tables 402, 404, 406 of FIG. 5 can employ various known or specially-developed interpolation/extrapolation routines for determination of values not precisely covered in tables.

Materials suitable for use in accomplishing the purposes described herein may be may include any materials suitable for accomplishing the purposes described herein. As will be understood by those skilled in the relevant arts, a wide number of such materials are currently understood and used in fabricating analogous prior art systems, and doubtless others will hereafter be developed. The selection of suitable materials will not trouble those skilled in the relevant arts.

The above descriptions are meant to be exemplary only, and one skilled in the art will recognize that changes may be made to the embodiments described without departing from the scope of the subject matter disclosed. Still other modifications which fall within the scope of the described subject matter will be apparent to those skilled in the art, in light of a review of this disclosure, and such modifications are intended to fall within the appended claims.

What is claimed is:

1. A system useful for controlling flow in a load compressor having an inlet and an outlet, the system comprising:

means for measuring static pressure at the load compressor inlet;

means for measuring static pressure at the load compressor outlet;

means for measuring temperature at at least one location within the compressor;

a processor adapted for calculating a ratio relating the measured compressor outlet pressure to the measured compressor inlet pressure, normalizing the calculated pressure ratio according to a reference temperature, and for determining, using the normalized pressure ratio, a desired load compressor output flow rate, the desired load compressor output flow rate useable for preventing surge in the load compressor or operating at a desired pressure, flow rate or efficiency.

2. The system of claim 1, wherein the means for measuring static pressure at the load compressor inlet is configured for measuring said static inlet pressure downstream of one or more inlet guide vanes.

3. The system of claim 1, wherein the means for measuring static pressure at the load compressor inlet is configured for measuring said static inlet pressure upstream of one or more variable-position inlet guide vanes, and the processor is further adapted for normalizing the calculated pressure ratio according to a reference inlet guide vane position in determining the desired load compressor output flow rate.

4. The system of claim 1, wherein the processor is further adapted for normalizing the calculated pressure ratio according to a reference compressor speed in a variable-speed compressor in determining the desired load compressor output flow rate.

5. The system of claim 1, further comprising means for controlling the load compressor output flow rate according to the calculated desired flow rate.

6. The system of claim 5, wherein the means for controlling the load compressor output flow rate comprises means for controlling a surge control valve.

7. The system of claim 1, wherein the means for measuring temperature at at least one location within the load compressor is configured to measure at least one of a compressor inlet temperature and a compressor outlet temperature.

8. The system of claim 1, wherein the processor is adapted for normalizing the calculated pressure ratio according to a reference temperature by use of a programmed table look-up function.

9. The system of claim 3, wherein the processor is adapted for normalizing the calculated pressure ratio according to a reference inlet guide vane position by use of a programmed table look-up function.

10. The system of claim 4, wherein the processor is adapted for normalizing the calculated pressure ratio according to a reference compressor speed by use of a programmed table look-up function.

11. A method for controlling flow in a load compressor having an inlet and an outlet, the method performed by an automatic data processor and comprising:

receiving a signal representative of a measured static pressure at the load compressor inlet;

receiving a signal representative of a measured static pressure at the load compressor outlet;

receiving a signal representative of a measured temperature at at least one location within the compressor;

calculating a ratio relating the measured compressor outlet pressure to the measured compressor inlet pressure, normalizing the calculated pressure ratio according to a reference temperature, and determining, using the normalized pressure ratio, at least one signal representative of a desired load compressor output flow rate, the at least one signal representative of the desired load compressor output flow rate being useful for preventing surge in the load compressor or operating at a desired pressure, flow rate or efficiency.

12. The method of claim 11, wherein the static pressure at the load compressor inlet is measured downstream of one or more inlet guide vanes.

13. The method of claim 11, wherein the static pressure at the load compressor inlet is measured upstream of one or more variable-position inlet guide vanes, and the method comprises normalizing the calculated pressure ratio according to a reference inlet guide vane position in determining the desired load compressor output flow rate.

14. The method of claim 11, comprising normalizing the calculated pressure ratio according to a reference compressor speed in a variable-speed compressor in determining the desired load compressor output flow rate.

15. The method of claim 11, further comprising controlling the load compressor output flow rate according to the calculated desired flow rate.

16. A load compressor comprising:

an inlet, and means for measuring static pressure at the inlet;

an outlet, and means for measuring static pressure at the outlet;

means for measuring temperature at at least one location within the compressor;

a processor adapted for calculating a ratio relating the measured outlet pressure to the measured inlet pressure, normalizing the calculated pressure ratio according to a reference temperature, and for determining, using the normalized pressure ratio, a desired load compressor output flow rate, the desired load compressor output flow rate useable for preventing surge in the load compressor.

17. The load compressor of claim 16, further comprising one or more inlet guide vanes, wherein the means for measuring static pressure at the load compressor inlet is configured for measuring said static inlet pressure downstream of said one or more inlet guide vanes.

18. The load compressor of claim 16, further comprising variable-position inlet guide vanes, wherein the means for measuring static pressure at the load compressor inlet is configured for measuring said static inlet pressure upstream of the one or more variable-position inlet guide vanes, and the processor is further adapted for normalizing the calculated pressure ratio according to a reference inlet guide vane position in determining the desired load compressor output flow rate.

19. The load compressor of claim 16, wherein the load compressor is a variable speed compressor, and the processor is further adapted for normalizing the calculated pressure ratio according to a reference compressor speed in determining the desired load compressor output flow rate.

20. The load compressor of claim 16, further comprising means for controlling the load compressor output flow rate according to the calculated desired flow rate.

21. The load compressor of claim 20, wherein the means for controlling the load compressor output flow rate comprises means for controlling a surge control valve.

22. A system useful for measuring flow in a load compressor having an inlet and an outlet, the system comprising:

means for measuring static pressure at the load compressor inlet;

means for measuring static pressure at the load compressor outlet;

means for measuring temperature at at least one location within the compressor;

a processor adapted for calculating a ratio relating the measured compressor outlet pressure to the measured compressor inlet pressure, normalizing the calculated pressure ratio according to a reference temperature, and for determining, using the normalized pressure ratio, a desired load compressor output flow rate, the desired load compressor output flow rate useable for preventing surge in the load compressor or operating at a desired pressure, flow rate or efficiency.

* * * * *